US011193738B1

(12) United States Patent
Schultheis et al.

(10) Patent No.: US 11,193,738 B1
(45) Date of Patent: Dec. 7, 2021

(54) DRONE DEFENSE SYSTEM

(71) Applicants: Michael Schultheis, Erkrath (DE); Udo Schultheis, Macomb, MI (US)

(72) Inventors: Michael Schultheis, Erkrath (DE); Udo Schultheis, Macomb, MI (US)

( * ) Notice: Subject to any disclaimer, the term of this patent is extended or adjusted under 35 U.S.C. 154(b) by 0 days.

(21) Appl. No.: 16/952,797

(22) Filed: Nov. 19, 2020

Related U.S. Application Data

(60) Provisional application No. 63/067,157, filed on Aug. 18, 2020.

(51) Int. Cl.
*F41H 11/02* (2006.01)
*H04K 3/00* (2006.01)

(52) U.S. Cl.
CPC ..... *F41H 11/02* (2013.01); *H04K 3/90* (2013.01)

(58) Field of Classification Search
CPC ..... F41H 11/02; H04K 3/90
USPC ..... 89/1.11
See application file for complete search history.

(56) References Cited

U.S. PATENT DOCUMENTS 10,907,940 B1 * 2/2021 Parker ..... F41H 11/02
11,073,362 B1 * 7/2021 Barnawi ..... F41H 11/02
2017/0183096 A1 * 6/2017 Meinhart ..... F41H 11/02
2017/0192089 A1 * 7/2017 Parker ..... F41H 11/02
2020/0062392 A1 * 2/2020 Yoon ..... G01S 19/015
2020/0272827 A1 * 8/2020 Morrow ..... G08G 5/0082
2021/0047034 A1 * 2/2021 Kim ..... H04K 3/90

FOREIGN PATENT DOCUMENTS

WO WO-2016122739 A2 * 8/2016 ..... H04K 3/45

* cited by examiner

*Primary Examiner* — Samir Abdosh
(74) *Attorney, Agent, or Firm* — Buckert Patent & Trademark Law Firm PC; John F. Buckert

(57) ABSTRACT

A drone defense system having a mast assembly with a telescoping mast is provided. The drone defense system includes a housing rotatably coupled to a top portion of the telescoping mast. The housing has a flying drone tracking system and a flying drone countermeasure system. The drone defense system includes a computer that communicates with the flying drone tracking system and the flying drone countermeasure system. The flying drone tracking system detects a flying drone within a predetermined distance from the housing and generates a detection signal in response to detecting the flying drone. The computer receives the detection signal and generates a first control signal in response to the detection signal. The flying drone countermeasure system transmits an RF jamming signal in response to the first control signal.

17 Claims, 4 Drawing Sheets

DRONE DEFENSE SYSTEM

CROSS-REFERENCE TO RELATED APPLICATION

This application claims priority to U.S. Provisional Patent Application No. 63/067,157 filed on Aug. 18, 2020, the entire contents of which are hereby incorporated by reference herein.

BACKGROUND

Flying drones have been utilized for many beneficial purposes. However, flying drones can also be utilized for undesirable, unlawful, and terrorist purposes. For example, a flying drone could be utilized to undesirably enter an un-authorized airspace above a private business. Also, a flying drone could be utilized to fly over a private residence of a celebrity and to take photographs or videos. Still further, a flying drone could be utilized to spy and take photographs or videos of a new car model driven on a car manufacturer's proving ground. Further, a flying drone could be utilized to fly over a sports stadium and to take unauthorized photographs or videos. Still further, a flying drone could be utilized near of an international airport in order to endanger airplane take-offs and landings.

The inventors herein have recognized a need for an improved drone defense system that can track a flying drone and that can take countermeasures to disable or destroy the flying drone when the flying drone is within a predetermined distance from the drone defense system to minimize and/or prevent the above-mentioned undesirable, unlawful, and terrorist purposes.

SUMMARY

A drone defense system in accordance with an exemplary embodiment is provided. The drone defense system includes a mast assembly having a telescoping mast. The drone defense system further includes a housing rotatably coupled to a top portion of the telescoping mast. The housing has a flying drone tracking system and a flying drone countermeasure system disposed therein. The drone defense system further includes a computer that operably communicates with the flying drone tracking system and the flying drone countermeasure system. The flying drone tracking system detects a flying drone within a predetermined distance from the housing and generates a detection signal in response to detecting the flying drone. The computer receives the detection signal and generates a first control signal in response to the detection signal. The flying drone countermeasure system transmits an RF jamming signal in response to the first control signal.

A drone defense system in accordance with another exemplary embodiment is provided. The drone defense system includes a mast assembly having a mast member and a positional actuator. The positional actuator is coupled to a top portion of the mast member. The drone defense system further includes a movable arm having a first end portion coupled to the positional actuator. The drone defense system further includes a housing that is coupled to a second end portion of the movable arm. The housing has a flying drone tracking system and a flying drone countermeasure system disposed therein. The drone defense system further includes a computer that operably communicates with the flying drone tracking system and the flying drone countermeasure system. The flying drone tracking system detects a flying drone within a predetermined distance from the housing and generates a detection signal in response to detecting the flying drone. The computer receives the detection signal and generates a first control signal in response to the detection signal. The flying drone countermeasure system transmits an RF jamming signal in response to the first control signal.

DETAILED DESCRIPTION

Figure 1:
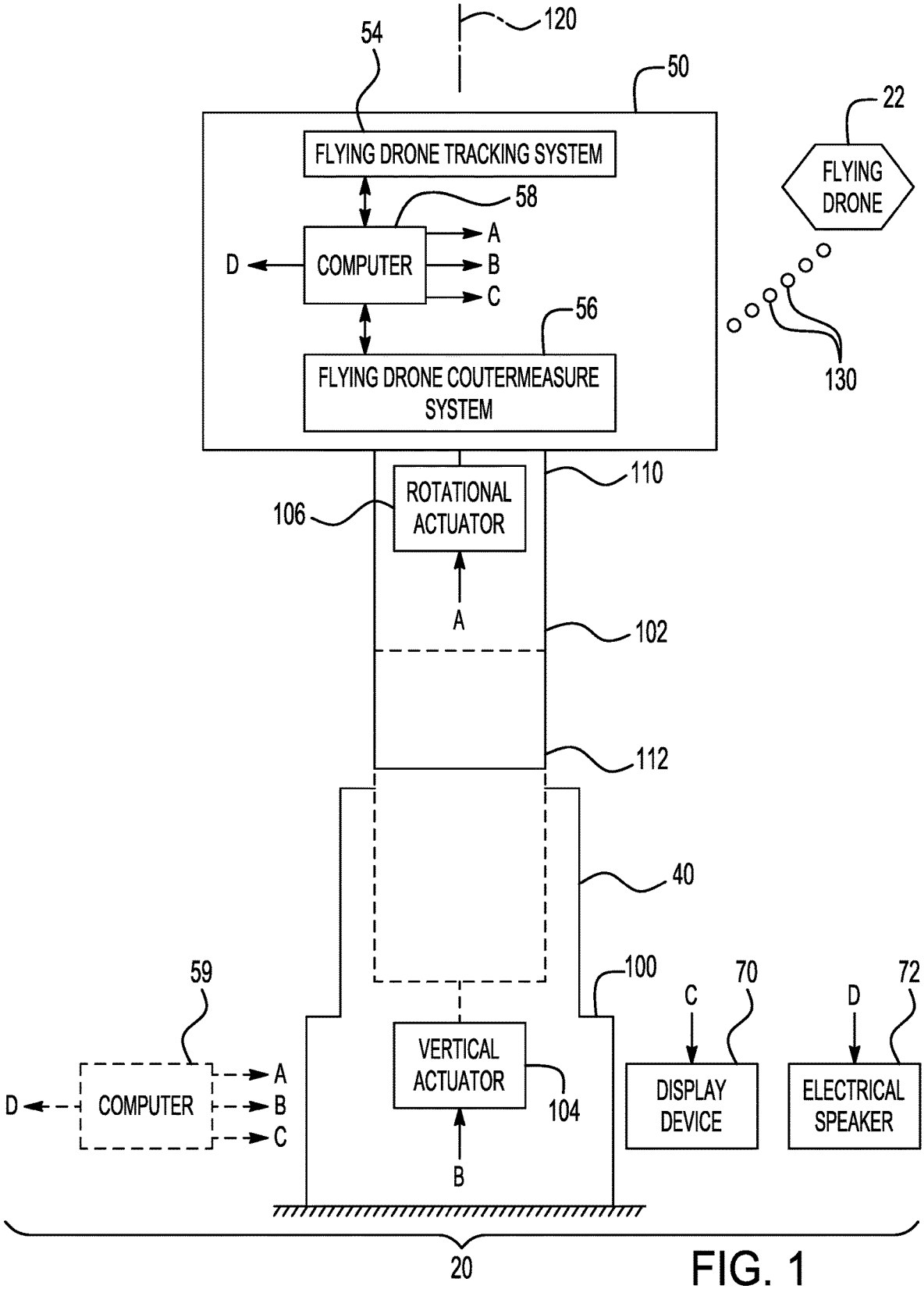
FIG. 1 is a schematic of a drone defense system in accordance with an exemplary embodiment.

Referring to FIG. 1, a drone defense system 20 in accordance with an exemplary embodiment, and a flying drone 22 are illustrated. The drone defense system 20 is utilized to detect the flying drone 22 and to implement countermeasures to disable operation of the flying drone 22 when the flying drone 22 is within a predetermined distance of the drone defense system 20. The drone defense system 20 includes a mast assembly 40, a housing 50, a computer 58, a flying drone tracking system 54, a flying drone countermeasure system 56, a display device 70, and an electrical speaker 72.

An advantage of the drone defense system 20 is that the system 20 utilizes a mast assembly 40 which can position a flying drone countermeasure system 56 at a desired vertical height and a desired rotational position to utilize countermeasures to disable operation of the flying drone 22.

The mast assembly 40 is provided to support the other components of the drone defense system 40 and to position the housing 50 and the flying drone countermeasure system 56 therein at a desired vertical height and a desired rotational position. The mast assembly 40 includes a base member 100, a telescoping mast 102, a vertical actuator 104, and a rotational actuator 106.

The base member 100 is coupled to the ground.

The telescoping mast 102 is slidably coupled to the base member 100, and has a top portion 110 and a bottom portion 112. The bottom portion 112 extends at least partially within the base member 100. The bottom portion 112 is further operably coupled to a vertical actuator 104 which moves the telescoping mast 102 either upwardly or downwardly along the longitudinal axis 120 of the telescoping mast assembly 40. The top portion 110 of the telescoping mast 102 is coupled to the housing 50.

The vertical actuator 104 is disposed within the base member 100 and is operably coupled to the telescoping mast 102. The vertical actuator 104 moves the telescoping mast 102 (and the housing 50) upwardly in response to a control signal received from the computer 58. Alternately, the vertical actuator 104 moves the telescoping mast 102 (and the housing 50) downwardly in response to another control signal received from the computer 58. In an exemplary embodiment, the vertical actuator 104 can move the telescoping mast 102 from a first operational position (shown in dashed lines in FIG. 1) to a second operational position (shown in solid lines in FIG. 1).

The rotational actuator 106 is disposed within a top portion of the telescoping mast 102. The rotational actuator 106 is further coupled to the housing 50. The rotational actuator 106 rotates the housing 50 in a first rotational direction about the longitudinal axis 120 in response to a control signal received from the computer 58. Alternately, the rotational actuator 106 moves the housing 50 in a second rotational direction about the longitudinal axis 120 in response to another control signal from the computer 58.

The housing 50 is provided to hold the computer 58, the flying drone tracking system 54, and the flying drone countermeasure system 56 therein. The housing 50 is rotatably coupled to the top portion 110 of the telescoping mast 102. The housing 50 includes openings therein to allow the flying drone countermeasure system 56 to launch projectiles towards the flying drone 22 to disable the flying drone 22.

The flying drone tracking system 54 is generate a detection signal when the flying drone 22 is within a predetermined distance from the system 54. In particular, the flying drone tracking system 54 generates a detection signal in response to detecting the flying drone 22 within the predetermined distance from the housing 50. The flying drone tracking system 54 sends the detection signal to the computer 58. In an exemplary embodiment, the flying drone tracking system 54 comprises an acoustical sensor which detects an operational sound of the flying drone 22 and generates the detection signal in response to receiving the operational sound. In another exemplary embodiment, the flying drone tracking system 54 comprises a radar system that utilizes radar waves to detect the flying drone 22 and generates the detection signal in response to receiving reflected radar waves from the flying drone 22. In yet another exemplary embodiment, the flying drone tracking system 54 comprises a digital camera which generates a digital image of the flying drone 22 and sends the digital image to the computer 58. The computer 58 has vision identification software which detects the flying drone 22 within the digital image. In an exemplary embodiment, the detection signal includes three-dimensional coordinates of the flying drone 22.

The flying drone countermeasure system 56 is provided to disable operation of the flying drone 22. The flying drone countermeasure system 56 is disposed within the housing 50. In an exemplary embodiment, the flying drone countermeasure system 56 transmits an RF jamming signal in response to receiving a control signal from the computer 58, which may disable operation of the flying drone 22. Further, the flying drone countermeasure system 56 is configured to launch one or more projectiles 130 at the flying drone 22 disable flying operation of the flying drone 22 in response to another control signal from the computer 58. The projectile 130 can comprise one of a metal projectile, a paint-ball, and a capturing net. In an alternative embodiment, the flying drone countermeasure system 56 can direct pressurized air or water at the flying drone 22 to disable operation of the flying drone 22 in response to another control signal from the computer 58.

The computer 58 is provided to control operation of the flying drone countermeasure system 56, the rotational actuator 106, the vertical actuator 104, a display device 70, and an electrical speaker 72. In an exemplary embodiment, the computer 58 is disposed within the housing 50 and is electrically coupled to and operably communicates with the flying drone countermeasure system 56, the rotational actuator 106, the vertical actuator 104, the display device 70, and the electrical speaker 72. The computer 58 receives a detection signal from the flying drone tracking system 54 when the system 54 detects the flying drone 22 within a predetermined distance from the housing 50. The detection signal is utilized by the computer 58 to determine three-dimensional coordinates of the flying drone 22. In response to the detection signal, the computer 58 generates a control signal to induce the vertical actuator 104 to move the telescoping mast upwardly or downwardly to a desired vertical position based on the three-dimensional coordinates of the flying drone 22 to allow the flying drone countermeasure system 56 to disable the flying drone 22. Further, the computer 58 generates another control signal to induce the rotational actuator 106 to move the housing 50 to a desired rotational position based on three-dimensional coordinates of the flying drone 22 to allow the flying drone countermeasure system 56 to disable the flying drone 22. Further, the computer 58 generates another control signal to induce the flying drone countermeasure system 56 to generate an RF jamming signal to attempt to disable operation of the flying drone 22, in response to the detection signal. Further, the computer 58 generates another control signal to induce the flying drone countermeasure system 56 to launch projectiles, water, or pressurized air at the flying drone 22 to disable flying operation of the flying drone 22, in response to the detection signal. Still further, the computer 58 generates another control signal to induce the display device 70 to display the position of the flying drone 22 based upon the three-dimensional coordinates of the flying drone 22. Still further, the computer 58 generates another control signal to induce the electrical speaker 72 to output a noise in response to the detection signal, to alert people that a flying drone 22 has been detected.

In an alternative embodiment, the computer 58 can be replaced with a computer 59 (shown in dashed lines in FIG. 1) that is disposed external and remote from the housing 50 and is electrically coupled to the flying drone countermeasure system 56, the rotational actuator 106, the vertical actuator 104, the display device 70, and the electrical speaker 72, wherein the computer 59 has the identical functionality as the computer 58.

Figure 2:
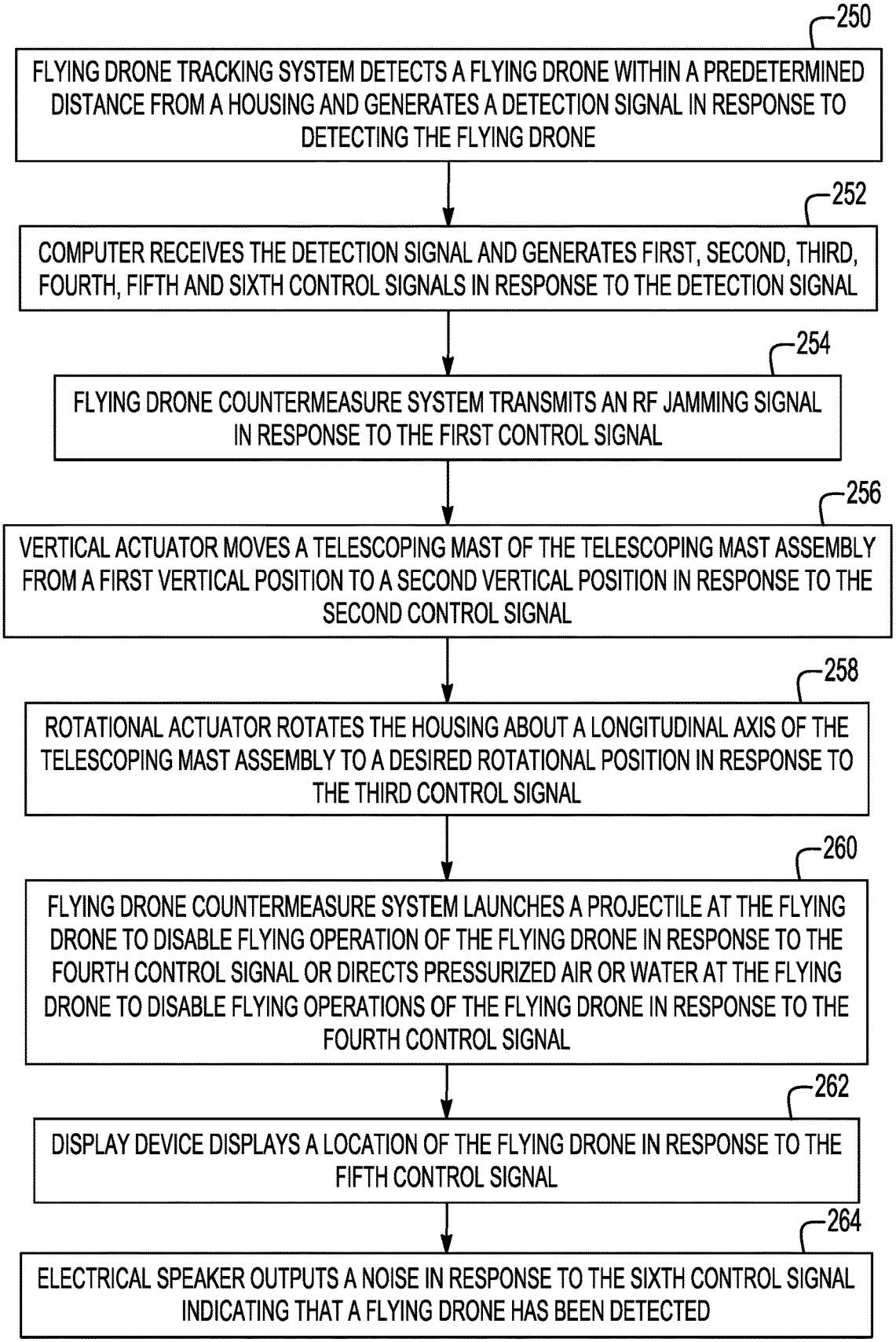
FIG. 2 is a flowchart of a method for disabling a flying drone utilizing the drone defense system of FIG. 1.

Referring to FIGS. 1 and 2, a flowchart of a method for disabling a flying drone 22 utilizing the drone defense system 20 will now be explained.

At step 250, the flying drone tracking system 54 detects a flying drone 22 within a predetermined distance from a housing 50 and generates a detection signal in response to detecting the flying drone 22.

At step 252, the computer 58 receives the detection signal and generates first, second, third, fourth, fifth, and sixth control signals in response to the detection signal.

At step 254, the flying drone countermeasure system 56 transmits an RF jamming signal in response to the first control signal.

At step 256, the vertical actuator 104 moves a telescoping mast 102 of the mast assembly 40 from a first vertical position to a second vertical position in response to the second control signal.

At step 258, the rotational actuator 106 rotates the housing 50 about a longitudinal axis 120 of the mast assembly 40 to a desired rotational position in response to the third control signal.

At step 260, the flying drone countermeasure system 56 launches a projectile 130 at the flying drone 22 to disable flying operation of the flying drone 22 in response to the fourth control signal or directs pressurized air or water at the flying drone 22 to disable flying operation of the flying drone 22 in response to the fourth control signal.

At step 262, the display device 70 displays a location of the flying drone 22 in response to the fifth control signal.

At step 264, the electrical speaker 72 outputs a noise in response to the sixth control signal indicating that the flying drone 22 has been detected.

Figure 3:
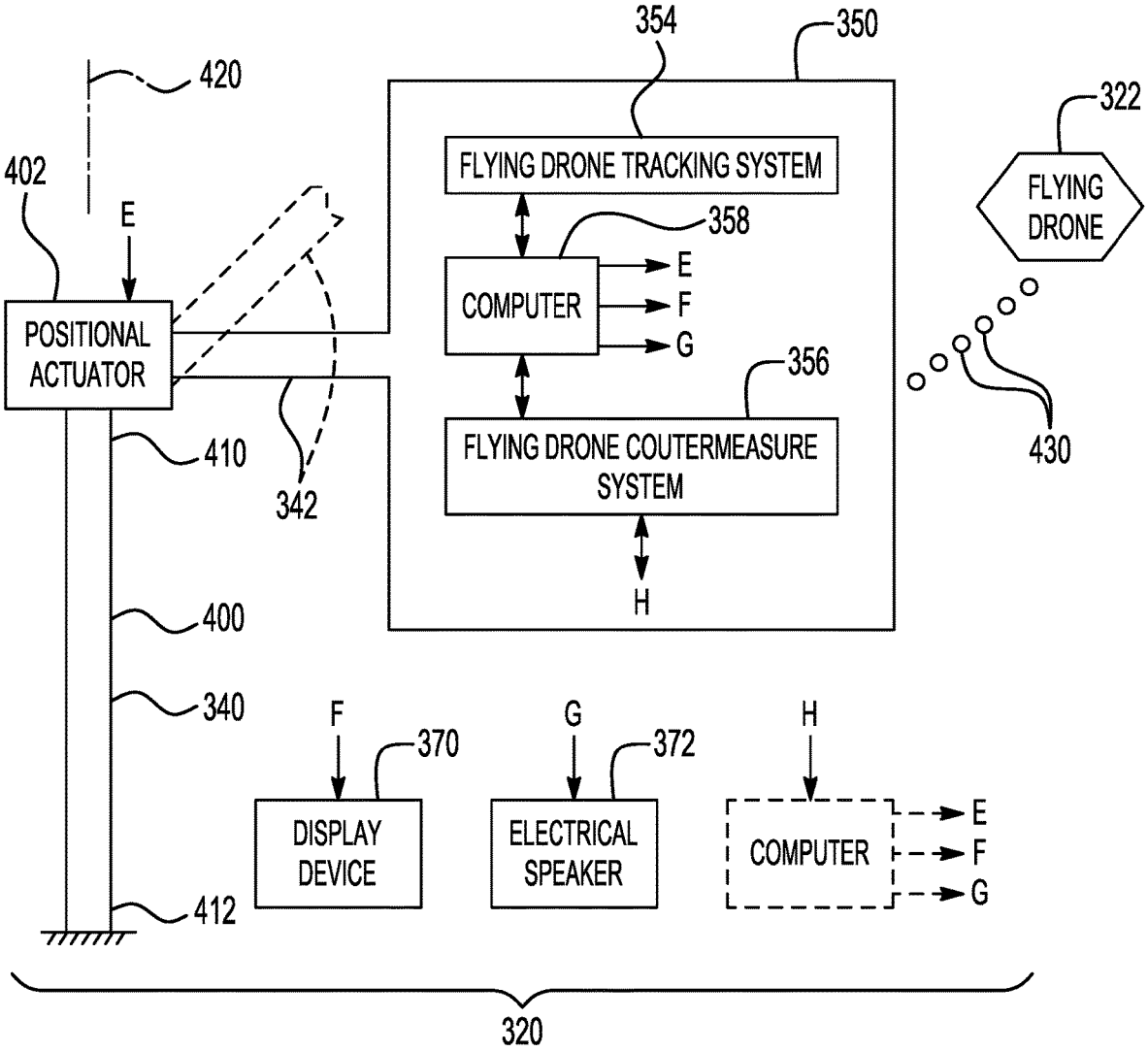
FIG. 3 is a schematic of a drone defense system in accordance with another exemplary embodiment.

Referring to FIG. 3, a drone defense system 320 in accordance with another exemplary embodiment, and a flying drone 322 are illustrated. The drone defense system 320 is utilized to detect the flying drone 322 and to implement countermeasures to disable operation of the flying drone 322 when the flying drone 322 is within a predetermined distance of the drone defense system 320. The drone defense system 320 includes a mast assembly 340, a movable arm 342, a housing 350, a computer 358, a flying drone tracking system 354, a flying drone countermeasure system 356, a display device 370, and an electrical speaker 372.

An advantage of the drone defense system 320 is that the system 320 utilizes a movable arm 342 which can position a flying drone countermeasure system 356 at a desired vertical height and a desired rotational position to utilize countermeasures to disable operation of the flying drone 322.

The mast assembly 340 is provided to support and move the other components of the drone defense system 40. The mast assembly 340 includes a mast member 400 and a positional actuator 402.

The mast member 400 is coupled to the ground. The mast member 400 includes a top portion 410 and a bottom portion 412. The bottom portion 412 is coupled to the ground. The top portion 410 is coupled to the positional actuator 402.

The positional actuator 402 is coupled to the top portion 410 of the mast member 400 and to the movable arm 342. The movable arm 342 is further coupled to the housing 350. The positional actuator 402 rotates the rotatable arm 342 (and the housing 350) about a longitudinal axis 420 to a desired rotational position, and further rotates the arm 342 (and the housing 350) upwardly or downwardly relative to ground level to a desired vertical position in response to a control signal from the computer 358. In an exemplary embodiment, the positional actuator 402 can move the movable arm 342 from a first operational position (shown in dashed lines in FIG. 3) to a second operational position (shown in solid lines in FIG. 3).

The housing 350 is provided to hold the computer 358, the flying drone tracking system 354, and the flying drone countermeasure system 356 therein. The housing 350 is coupled to the movable arm 342. The housing 350 includes openings therein to allow the flying drone countermeasure system 356 to launch projectiles towards the flying drone 322 to disable the flying drone 322.

The flying drone tracking system 354 is provided to generate a detection signal when the flying drone 322 is within a predetermined distance from the system 354. In particular, the flying drone tracking system 354 generates a detection signal in response to detecting the flying drone 322 within the predetermined distance from the housing 350. The flying drone tracking system 354 sends the detection signal to the computer 358. In an exemplary embodiment, the flying drone tracking system 354 comprises an acoustical sensor which detects an operational sound of the flying drone 322 and generates the detection signal in response to receiving the operational sound. In another exemplary embodiment, the flying drone tracking system 354 comprises a radar system that utilizes radar waves to detect the flying drone 322 and generates the detection signal in response to receiving reflected radar waves from the flying drone 322. In yet another exemplary embodiment, the flying drone tracking system 354 comprises a digital camera which generates a digital image of the flying drone 322 and sends the digital image to the computer 358. The computer 358 has vision identification software which detects the flying drone 322 within the digital image. In an exemplary embodiment, the detection signal includes three-dimensional coordinates of the flying drone 322.

The flying drone countermeasure system 356 is provided to disable operation of the flying drone 322. The flying drone countermeasure system 356 is disposed within the housing 350. In an exemplary embodiment, the flying drone countermeasure system 356 transmits an RF jamming signal in response to receiving a control signal from the computer 358, which may disable operation of the flying drone 322. Further, the flying drone countermeasure system 356 is configured to launch one or more projectiles 130 at the flying drone 322 disable flying operation of the flying drone 322 in response to another control signal from the computer 358. The projectile 430 can comprise one of a metal projectile, a paint-ball, and a capturing net. In an alternative embodiment, the flying drone countermeasure system 356 can direct pressurized air or water at the flying drone 322 to disable operation of the flying drone 322 in response to another control signal from the computer 358.

The computer 358 is provided to control operation of the flying drone countermeasure system 356, the positional actuator 402, a display device 370, and an electrical speaker 372. In an exemplary embodiment, the computer 358 is disposed within the housing 350 and is electrically coupled to and operably communicates with the flying drone countermeasure system 356, the positional actuator 402, the display device 370, and the electrical speaker 372.

In an alternative embodiment, the computer 358 is disposed external and remote from the housing 50 and is electrically coupled to the flying drone countermeasure system 356, the positional actuator 402, the display device 370, and the electrical speaker 372. The computer 358 receives a detection signal from the flying drone tracking system 354 when the system 54 detects the flying drone 322 within a predetermined distance from the housing 350. The detection signal is utilized by the computer 358 to determine three-dimensional coordinates of the flying drone 322. In response to the detection signal, the computer 358 generates a control signal to induce the positional actuator 402 to move the movable arm 342 (and the housing 350) upwardly or downwardly to a desired vertical position based on the three-dimensional coordinates of the flying drone 322 to allow the flying drone countermeasure system 356 to disable the flying drone 322. Further, the computer 358 generates another control signal to induce the flying drone countermeasure system 356 to generate an RF jamming signal to attempt to disable operation of the flying drone 322, in response to the detection signal. Further, the computer 358 generates another control signal to induce the flying drone countermeasure system 356 to launch projectiles, water, or pressurized air at the flying drone 322 to disable flying operation of the flying drone 322, in response to the detection signal. Still further, the computer 358 generates another control signal to induce the display device 72 display the position of the flying drone 322 based upon the three-dimensional coordinates of the flying drone 322. Still further, the computer 358 generates another control signal to induce the electrical speaker 372 to output a noise in response to the detection signal, to alert people that a flying drone 322 has been detected.

In an alternative embodiment, the computer 358 can be replaced with a computer 359 (shown in dashed lines in FIG. 3) that is disposed external and remote from the housing 350 and is electrically coupled to the flying drone countermeasure system 356, the positional actuator 402, the display device 370, and the electrical speaker 372, wherein the computer 359 has the identical functionality as the computer 358.

Figure 4:
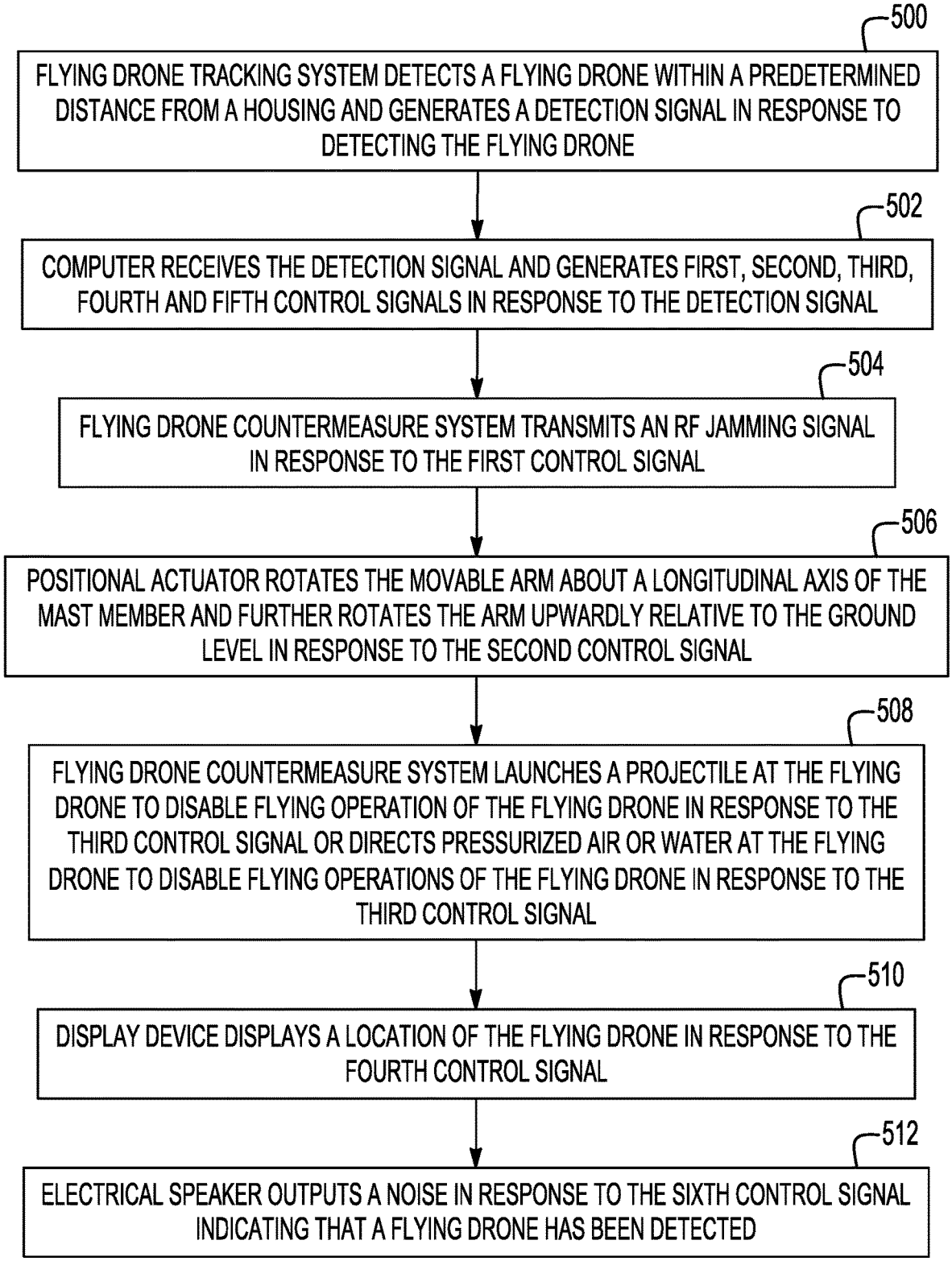
FIG. 4 is a flowchart of a method for disabling a flying drone utilizing the drone defense system of FIG. 3.

Referring to FIGS. 3 and 4, a flowchart of a method for disabling a flying drone 322 utilizing the drone defense system 320 will now be explained.

At step 500, the flying drone tracking system 354 detects a flying drone 322 within a predetermined distance from a housing 350 and generates a detection signal in response to detecting the flying drone 322.

At step 502, the computer 358 receives the detection signal and generates first, second, third, fourth, and fifth, control signals in response to the detection signal.

At step 504, the flying drone countermeasure system 356 transmits an RF jamming signal in response to the first control signal.

At step 506, the positional actuator 402 rotates the movable arm 342 about a longitudinal axis 420 of the mast member 400 and further rotates the arm 342 upwardly relative to a ground level in response to the second control signal.

At step 508, the flying drone countermeasure system 356 launches a projectile 430 at the flying drone 322 to disable flying operation of the flying drone 322 in response to the third control signal or directs pressurized air or water at the flying drone 322 to disable flying operation of the flying drone 322 in response to the third control signal.

At step 510, the display device 370 displays a location of the flying drone 322 in response to the fourth control signal.

At step 512, the electrical speaker 372 outputs a noise in response to the fifth control signal indicating that the flying drone 322 has been detected.

The drone defense systems described herein provide a substantial advantage over other systems. In particular, the drone defense system 20 utilizes a mast assembly which can position a flying drone countermeasure system at a desired vertical height and a desired rotational position to utilize countermeasures to disable operation of the flying drone.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A drone defense system, comprising:

a mast assembly having a telescoping mast;

a housing being coupled to a top portion of the telescoping mast, the housing having a flying drone tracking system and a flying drone countermeasure system disposed therein;

a computer operably communicating with the flying drone tracking system and the flying drone countermeasure system;

the flying drone tracking system detecting a flying drone within a predetermined distance from the housing and generating a detection signal in response to detecting the flying drone;

the computer receiving the detection signal and generating a first control signal in response to the detection signal; and the flying drone countermeasure system transmitting an RF jamming signal in response to the first control signal.

2. The drone defense system of claim 1, wherein:

the computer generating a second control signal in response to the detection signal; and the flying drone countermeasure system further launches a projectile at the flying drone to disable flying operation of the flying drone in response to the second control signal.

3. The drone defense system of claim 2, wherein:

the projectile comprises one of a metal projectile, a paint-ball, and a capturing net.

4. The drone defense system of claim 1, wherein:

the computer generating a second control signal in response to the detection signal; and the flying drone countermeasure system further directs pressurized air or water at the flying drone to disable flying operation of the flying drone in response to the second control signal.

5. The drone defense system of claim 1, wherein:

the mast assembly further including a rotational actuator coupled to and between the top portion of the telescoping mast and the housing;

the computer generating a second control signal in response to the detection signal; and the rotational actuator rotating the housing about a longitudinal axis of the mast assembly to a desired rotational position in response to the second control signal.

6. The drone defense system of claim 1, wherein:

the mast assembly further including a vertical actuator coupled to the telescoping mast;

the computer generating a second control signal in response to the detection signal; and the vertical actuator moving the top portion of the telescoping mast from a first vertical position to a second vertical position in response to the second control signal.

7. The drone defense system of claim 1, wherein:

the computer generating a second control signal to induce a display device to display a location of the flying drone in response to the detection signal.

8. The drone defense system of claim 1, further comprising:

an electrical speaker;

the computer generating a second control signal in response to the detection signal; and the electrical speaker outputting a noise in response to the second control signal.

9. The drone defense system of claim 1, wherein:

the flying drone tracking system comprises one of an acoustical sensor, a radar system, and a digital camera.

10. A drone defense system, comprising:

a mast assembly having a mast member and a positional actuator, the positional actuator coupled to a top portion of the mast member;

a movable arm having a first end portion coupled to the positional actuator;

a housing being coupled to a second end portion of the movable arm, the housing having a flying drone tracking system and a flying drone countermeasure system disposed therein;

a computer operably communicating with the flying drone tracking system and the flying drone countermeasure system;

the flying drone tracking system detecting a flying drone within a predetermined distance from the housing and generating a detection signal in response to detecting the flying drone;

the computer receiving the detection signal and generating a first control signal in response to the detection signal; and the flying drone countermeasure system transmitting an RF jamming signal in response to the first control signal.

11. The drone defense system of claim 10, wherein:

the computer generating a second control signal in response to the detection signal; and the flying drone countermeasure system further launches a projectile at the flying drone to disable flying operation of the flying drone in response to the second control signal.

12. The drone defense system of claim 11, wherein:

the projectile comprises one of a metal projectile, a paint-ball, and a capturing net.

13. The drone defense system of claim 10, wherein:

the computer generating a second control signal in response to the detection signal; and the flying drone countermeasure system further directs pressurized air or water at the flying drone to disable flying operation of the flying drone in response to the second control signal.

14. The drone defense system of claim 10, further comprising:

the computer generating a second control signal in response to the detection signal; and the positional actuator rotating the movable arm about a longitudinal axis of the mast assembly and further rotating the arm upwardly relative to a ground level in response to the second control signal.

15. The drone defense system of claim 10, wherein:

the computer generating a second control signal to induce a display device to display a location of the flying drone in response to the detection signal.

16. The drone defense system of claim 10, further comprising:

an electrical speaker;

the computer generating a second control signal in response to the detection signal; and the electrical speaker outputting a noise in response to the second control signal.

17. The drone defense system of claim 10, wherein:

the flying drone tracking system comprises one of an acoustical sensor, a radar system, and a digital camera.

* * * * *